US011432373B2

(12) United States Patent
McDonnell et al.

(10) Patent No.: US 11,432,373 B2
(45) Date of Patent: Aug. 30, 2022

(54) COMPACT ROBUST CONNECTOR ASSEMBLY FOR HIGH VOLTAGE ELECTRICAL HEATERS

(71) Applicant: Watlow Electric Manufacturing Company, St. Louis, MO (US)

(72) Inventors: Brad McDonnell, St. Louis, MO (US); Curt St. Clair, St. Louis, MO (US); Michael Ruhr, St. Louis, MO (US)

(73) Assignee: WATLOW ELECTRIC MANUFACTURING COMPANY, St. Louis, MO (US)

( * ) Notice: Subject to any disclaimer, the term of this patent is extended or adjusted under 35 U.S.C. 154(b) by 879 days.

(21) Appl. No.: 16/266,345

(22) Filed: Feb. 4, 2019

(65) Prior Publication Data

US 2019/0261461 A1 Aug. 22, 2019

Related U.S. Application Data

(60) Provisional application No. 62/632,273, filed on Feb. 19, 2018.

(51) Int. Cl.
*H05B 3/08* (2006.01)
*H01R 13/52* (2006.01)
(Continued)

(52) U.S. Cl.
CPC ..... *H05B 3/08* (2013.01); *H01R 4/20* (2013.01); *H01R 13/5208* (2013.01);
(Continued)

(58) Field of Classification Search
CPC ... H05B 3/08; H05B 3/40; H01R 4/20; H01R 13/5208; H01R 13/533; H01R 4/023; H01R 13/622; H01R 13/6592
See application file for complete search history.

(56) References Cited

U.S. PATENT DOCUMENTS 3,305,668 A * 2/1967 Smith ..... H05B 3/565 219/535
5,756,972 A 5/1998 Vranicar et al.
(Continued)

FOREIGN PATENT DOCUMENTS

| | | |
|---|---|---|
| CN | 1744391 | 3/2006 |
| CN | 103620881 | 3/2014 |
| EP | 1313170 | 5/2003 |

OTHER PUBLICATIONS

International Search Report for International Application PCT/US2019/016471, dated Jul. 9, 2019.
(Continued)

*Primary Examiner* — Travis S Chambers
(74) *Attorney, Agent, or Firm* — Burris Law, PLLC

(57) ABSTRACT

An electrical heater and method includes heating member, a cable, and a connector. A resistance heating element is within a sheath of the heating member. A proximal end of the sheath is inserted into a slot of a first fitting and welded to the first fitting with first and second leads extending into the first fitting. The second fitting is threadably engaged with the first fitting. The second fitting defines a central bore disposed about the axis. An end of a power cable extends into the second central bore. A first wire is coupled to the first lead. A second wire is coupled to the second lead.

27 Claims, 12 Drawing Sheets

(51) Int. Cl.

| | |
|---|---|
| ***H01R 13/533*** | (2006.01) |
| ***H05B 3/40*** | (2006.01) |
| ***H01R 4/20*** | (2006.01) |
| *H01R 4/02* | (2006.01) |
| *H01R 13/6592* | (2011.01) |
| *H01R 13/622* | (2006.01) |

(52) U.S. Cl.
CPC ..... *H01R 13/533* (2013.01); *H05B 3/40* (2013.01); *H01R 4/023* (2013.01); *H01R 13/622* (2013.01); *H01R 13/6592* (2013.01)

(56) References Cited

U.S. PATENT DOCUMENTS

| | | | | |
|---|---|---|---|---|
| 5,828,810 | A * | 10/1998 | Frank | H05B 3/80 219/544 |
| 5,998,772 | A | 12/1999 | Kirma et al. | |
| 6,353,708 | B1 * | 3/2002 | Reusche | H05B 3/82 392/455 |
| 7,665,890 | B2 | 2/2010 | Culbertson et al. | |
| 2014/0110399 | A1 | 4/2014 | Noritake et al. | |

OTHER PUBLICATIONS

Office Action issued in corresponding Chinese Application No. 201980014260.5 dated Oct. 8, 2021, 14 pages.
Watlow, Firebar®? Flat Tubular Heaters, product information, 2002, 2010.

* cited by examiner

COMPACT ROBUST CONNECTOR ASSEMBLY FOR HIGH VOLTAGE ELECTRICAL HEATERS

CROSS-REFERENCE TO RELATED APPLICATIONS

This application claims priority to Provisional Application No. 62/632,273, filed on Feb. 19, 2018. The disclosure of the above application is incorporated herein by reference.

FIELD

The present disclosure relates to connector assemblies for high voltage electrical heaters.

BACKGROUND

The statements in this section merely provide background information related to the present disclosure and may not constitute prior art.

High voltage electrical heaters typically include a power cable coupled to an electric resistance heating element that is configured to emit heat. The heating element is typically encased in a thermally conductive dielectric material which is surrounded by a metal sheath. The sheath protects the heating element and, in some applications, is configured to be immersed within a fluid. In other applications, the sheath can be affixed to a heat sink or heat exchanger for conduction or radiation of heat thereto, or can be disposed in a flowing fluid (e.g., a forced air application).

The connection between the sheath and the high voltage power cable of typical high voltage heaters can be a locus for failure of the heater. Typically, the ends of the power cable are encased in a hardened potting material. In some applications, this potting material is exposed to high temperature fluctuations, corrosive chemicals, water, high vibrations, and repeated physical loading. For example, high voltage heaters used to heat asphalt in a paving screed can be left outside at a job site through temperatures the dip below freezing and still be required to warm up to an operating temperature of around 300° C.-500° C. to preheat the screed plate assembly. Such heaters are also typically exposed to rain, snow, ice, road salt, gasoline or diesel fuels, oils, grease, asphalt, dirt, and other contaminants, as well as high vibrations from the machinery they are used on. Furthermore, since the sheath is rigid and the power cable is typically a flexible cable, the power cable can be prone to kinking, bending, or abrasion at its connection with the sheath. These conditions can lead to breakdown of the hardened potting material, which can lead to ingress of moisture and contaminants into the electrical connections between the power cable and the heating element and into the heating element itself.

Additionally, it can be beneficial for the heater to be smaller in size to fit packaging constraints on the application or to minimize material costs. However, some applications would have better flow and/or heat transfer characteristics from a generally flat sheath, yet typical flat sheath connections to power cables are larger in size and more difficult to manufacture than similar powered round sheath heaters.

These issues with packaging constraints, fluid and moisture ingress, corrosion, and high temperature fluctuations are addressed by the present disclosure.

SUMMARY

In one form, the present teachings provide for an electrical heater includes a heating member, a cable, and a connector.

The heating member includes a thermally conductive sheath, a resistance heating element, a first lead, and a second lead. The resistance heating element is disposed within the sheath. The first and second leads are coupled to the resistance heating element and extend from a proximal end of the sheath. The cable includes an insulating jacket, a first wire, and a second wire. The first and second wires are disposed within the insulating jacket and extend from a proximal end of the insulating jacket. The connector couples the heating member to the cable. The connector includes a first fitting and a second fitting. The first fitting includes a first connecting portion and a head portion. The first connecting portion defines threads disposed about an axis. The head portion is axially adjacent to the first connecting portion. The head portion defines a slot open through an end of the head portion that is opposite the first connecting portion. The first fitting includes a first central bore disposed about the axis. The first central bore is open to the slot and open through an end of the first connecting portion that is opposite the head portion. The proximal end of the sheath is received in the slot and welded to the first fitting. The first lead extends from the sheath into the first central bore. The second lead extends from the sheath into the first central bore. The second fitting includes a second connecting portion that defines threads threadably engaged with the threads of the first fitting. The second fitting defines a second central bore disposed about the axis. An end of the cable extends into the second central bore. The first wire is coupled to the first lead for electrical communication therewith. The second wire is coupled to the second lead for electrical communication therewith.

According to a further form, a first layer of potting material is disposed within the proximal end of the sheath. The first layer of potting material seals the proximal end of the sheath. A portion of the first and second leads extends from the first layer of potting material. The connector includes a plurality of inner sleeves. One of the inner sleeves is disposed about the portion of the first lead that extends from the first layer of potting material. Another one of the inner sleeves is disposed about the portion of the second lead that extends from the first layer of potting material. A second layer of potting material is disposed within the first fitting about a portion of the inner sleeves that is adjacent to the first layer of potting material.

According to another form, the connector includes a plurality of outer sleeves, one of the outer sleeves is disposed about a connection between the first wire and the first lead, an insulating coating of the first wire, and a portion of the inner sleeve that is disposed about the first lead. Another one of the outer sleeves is disposed about a connection between the second wire and the second lead, an insulating coating of the second wire, and a portion of the inner sleeve that is disposed about the second lead.

According to yet a further form, the outer sleeve does not extend into the second layer of potting material.

According to yet another form, the connector includes a perimeter sleeve that is disposed about the plurality of outer sleeves.

According to still a further form, the slot is defined by a first side wall, a second side wall parallel to the first side wall, a first end wall joining one end of the first and second side walls, and a second end wall joining an opposite end of the first and second side walls. The side walls are longer than the end walls. The proximal end of the sheath has a shape that is similar to and mates with the slot.

According to still another form, the first and second end walls are rounded.

According to a further form, the first and second end walls extend radially outward of a minor diameter of the threads of the first fitting.

According to another form, the electrical heater further includes a grommet. The second fitting includes a tubular portion disposed about the axis and extending from an end of the second connecting portion. The grommet is formed of a resilient material and is a generally cylindrical shape that has a relaxed outer diameter that is greater than an inner diameter of the tubular portion. The first and second wires extend through the grommet.

According to yet a further form, the electrical heater further includes a cable sleeve. The cable sleeve surrounds a portion of the insulating jacket proximate to the tubular portion and extends over the tubular portion. The cable sleeve forms a seal with the tubular portion.

According to yet another form, the electrical heater further includes a clamp disposed about the sleeve and the tubular portion. The clamp secures the sleeve to the tubular portion.

According to still a further form, the cable further includes a third wire coupled for electrical communication with the sheath.

According to still another form, the electrical heater further includes a ground pin coupled to the first fitting. The third wire is connected to the ground pin.

According to a further form, the first fitting defines a grounding bore in the end of the head portion opposite the first connecting portion. The ground pin extends into the grounding bore and is welded to the first fitting.

According to another form, the head portion of the first fitting defines a first recess and a second recess. The first recess is recessed from a shoulder of the slot at a first longitudinal end of the slot. The second recess is recessed from a shoulder at a second longitudinal end of the slot. The first lead extends from the sheath proximate to the first recess and angles toward the first central bore. The second lead extends from the sheath proximate to the second recess and angles toward the first central bore.

According to yet a further form, the first lead is surrounded by a first insulating sleeve that extends partially within the first recess and the second lead is surrounded by a second insulating sleeve that extends partially within the second recess.

According to yet another form, the first and second recesses extend radially outward of a minor diameter of external threads.

In another form, the present teachings provide for a method of coupling a power cable to an electric heater member. The power cable including a first wire, a second wire, and an insulating jacket. The heater member includes a resistance heating element, a sheath surrounding the resistance heating element, and first and second leads coupled to the resistance heating element and extending from a proximal end of the sheath. The method includes inserting the proximal end of the sheath into a slot of a first fitting so that the first and second leads extend through the first fitting, welding the sheath to the first fitting, inserting a portion of the cable through a tubular portion of a second fitting, coupling the first lead to the first wire, coupling the second lead to the second wire, threading the second fitting onto the first fitting, and crimping the tubular portion about the cable to secure the cable relative to the tubular portion.

According to a further form, the method further includes baking the sheath to remove moisture from within the sheath.

According to another form, the method further includes inserting the portion of the cable through a resilient grommet, and inserting the resilient grommet into the tubular portion before crimping the tubular portion, the grommet having a relaxed outer diameter that is greater than a crimped inner diameter of the tubular portion so that the grommet forms a seal between the insulating jacket and the tubular portion after crimping the tubular portion.

According to yet a further form, the method further includes positioning an outer sleeve over the tubular portion and a length of the insulating jacket after crimping the tubular portion, and securing the outer sleeve to the tubular portion.

According to yet another form, the method further includes pouring a first layer of potting material into the proximal end of the sheath, and curing the first layer of potting material to seal the proximal end of the sheath.

According to a further form, the method further includes positioning a first inner sleeve about the first lead and a second inner sleeve about the second lead, pouring second layer of potting material into the first fitting around the first and second inner sleeves, and curing the second layer of potting material.

According to another form, the method further includes positioning a first outer sleeve so that the first outer sleeve is disposed about the first wire, a connection between the first wire and the first lead, and a portion of the first inner sleeve, and positioning a second outer sleeve so that the second outer sleeve is disposed about the second wire, a connection between the second wire and the second lead, and a portion of the second inner sleeve.

According to yet a further form, the method further includes positioning a perimeter sleeve so that the perimeter sleeve is within the first and second fittings and disposed about the first and second outer sleeves.

According to yet another form, the method further includes welding a grounding pin to the first fitting, and connecting a third wire of the cable to the grounding pin for electrical communication therewith.

According to still a further form, the method further includes applying a high-temperature thread sealant to threads of at least one of the first and second fittings before threading the second fitting onto the first fitting.

Further areas of applicability will become apparent from the description provided herein. It should be understood that the description and specific examples are intended for purposes of illustration only and are not intended to limit the scope of the present disclosure.

DRAWINGS

In order that the disclosure may be well understood, there will now be described various forms thereof, given by way of example, reference being made to the accompanying drawings, in which.

Figure 1:
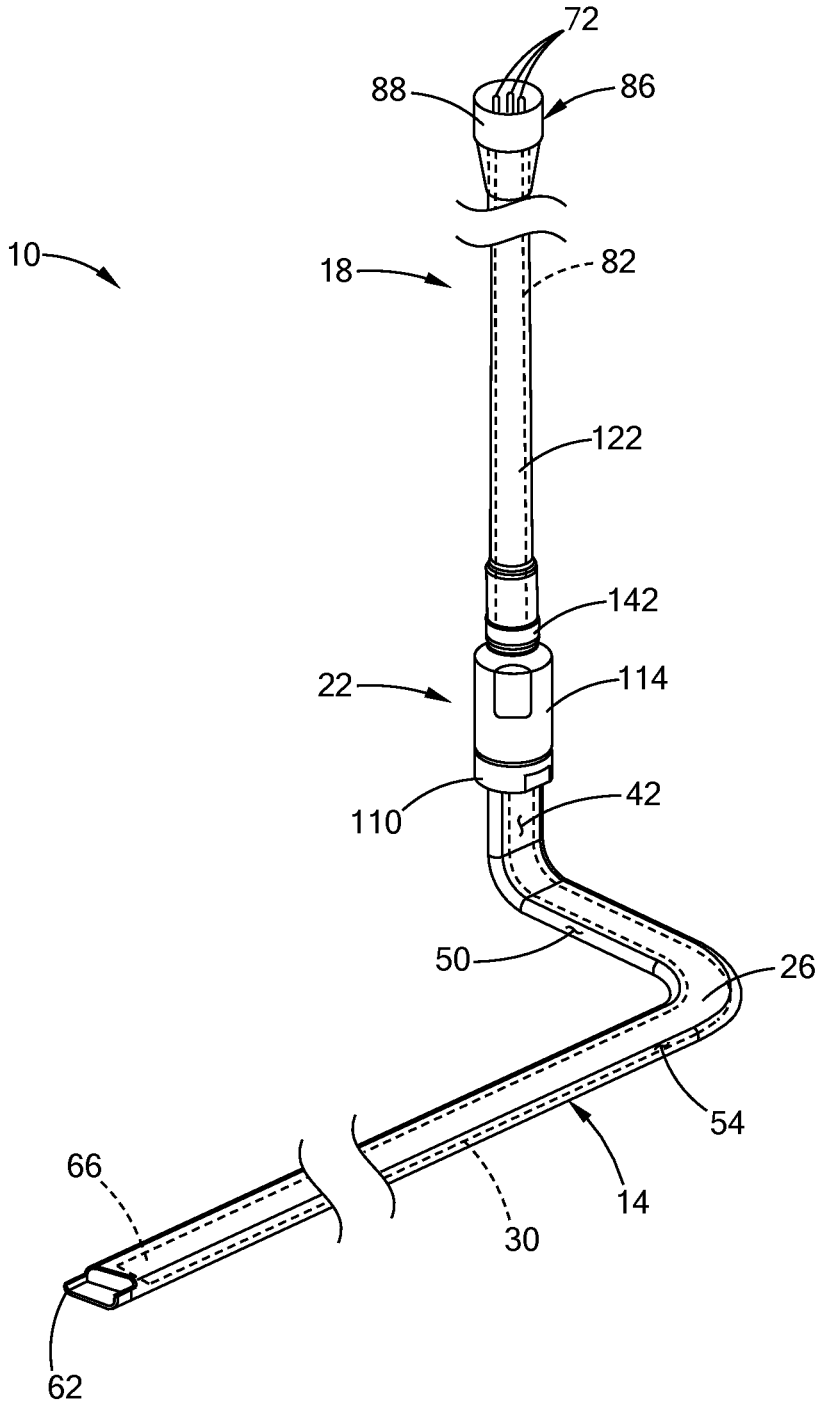
FIG. 1 is a front perspective view of an electric heater in accordance with the teachings of the present disclosure, illustrating a connector assembly of the electric heater.
Figure 2:
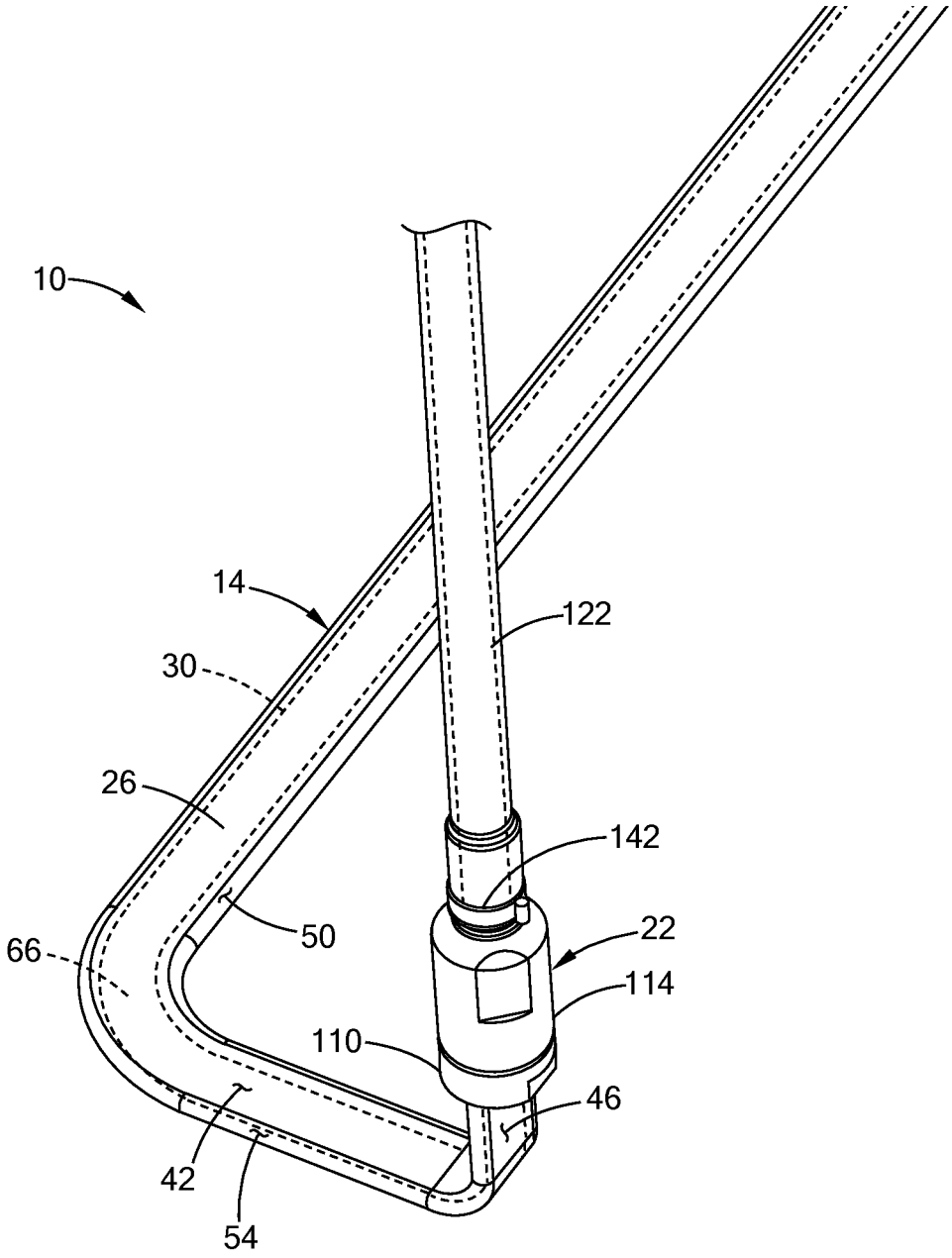
FIG. 2 is a rear perspective view of the electric heater of FIG. 1.
Figure 3:
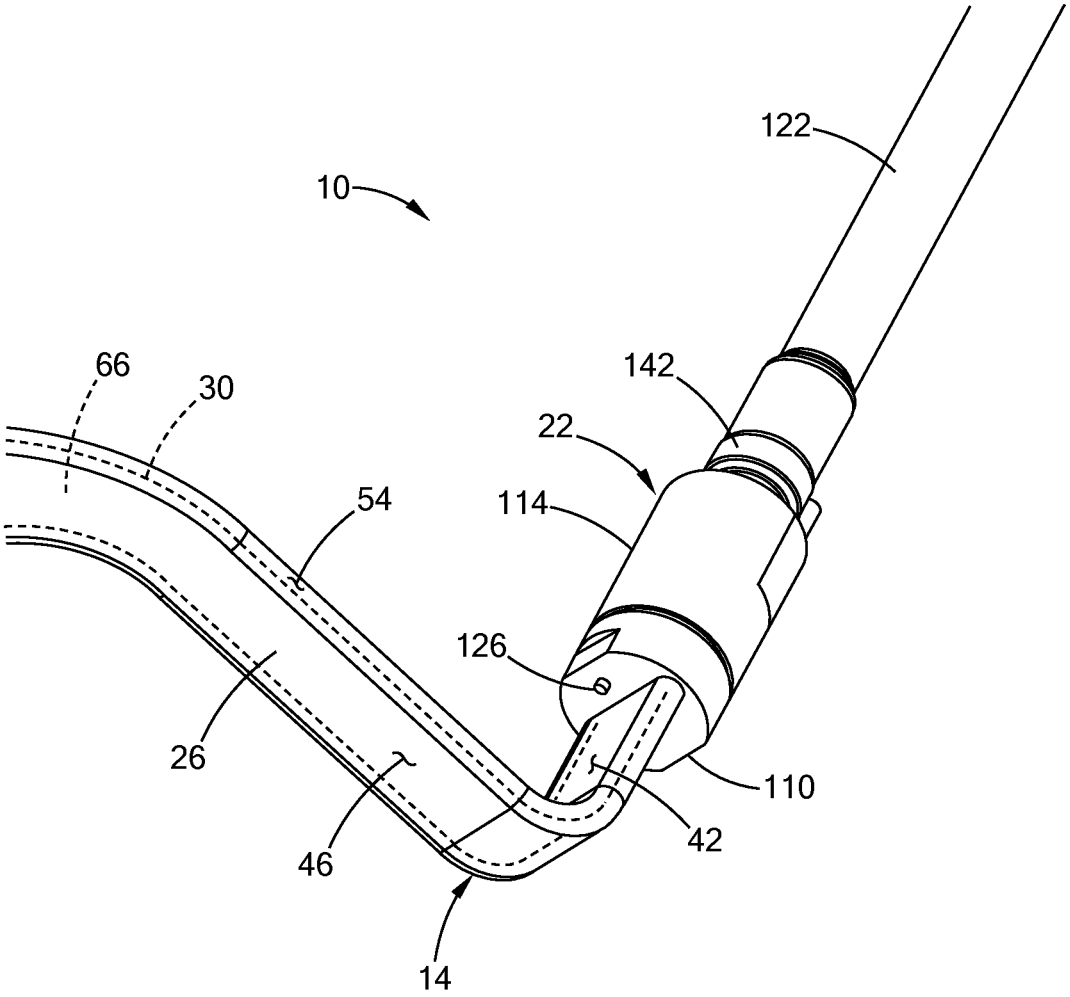
FIG. 3 is a bottom perspective view of the electric heater of FIG. 1.

The drawings described herein are for illustration purposes only and are not intended to limit the scope of the present disclosure in any way.

DETAILED DESCRIPTION

The following description is merely exemplary in nature and is not intended to limit the present disclosure, application, or uses. It should be understood that throughout the drawings, corresponding reference numerals indicate like or corresponding parts and features.

Referring to FIGS. 1-4, an electric heater 10 is illustrated. In the example provided, the electric heater 10 can be used for heating paving media (e.g., asphalt) in a screed paver that can be used for paving roadways and other surfaces on which vehicles operate. As such, the electric heater 10 is configured to reach operating temperatures of up to approximately 500° C., while being exposed to numerous oils, fuels, corrosive chemicals, dirt, water, ice, and environmental temperatures below 0° C. It is understood that the teachings of the present disclosure can also apply to other heater applications.

The electric heater 10 includes a heating member 14, a power cable 18, and a connector assembly 22. The heating member 14 includes a sheath 26, a resistance heating element 30, a first lead 34, and a second lead 38. In an alternative construction, the heating member can also include a third lead (not shown).

The sheath 26 is formed of a thermally conductive material such as 304 stainless steel, or Alloy 800 for example. In the example provided, the sheath 26 is a one-piece tube that has a generally rectangular shaped cross-section formed by a front sheath surface 42, a back sheath surface 46, and a pair of side sheath surfaces 50, 54. The front and back sheath surfaces 42, 46 are flat and parallel to each other. In the example provided, the side sheath surfaces 50, 54 are rounded and can have a diameter that is equal to the distance between the front and back sheath surfaces 42, 46 so that the side sheath surfaces 50, 54 can tangently join the front and back sheath surfaces 42, 46.

The sheath 26 extends from a proximal end 58 that is attached to the connector assembly 22 to a distal end 62 that is spaced apart from the connector assembly 22. The sheath 26 can extend from the proximal end 58 to the distal end 62 along any path suitable for heating the environment in which the electric heater 10 is intended to be used. In the example provided, the path extends straight a relatively short distance in a first direction, then bends to extend straight for a distance slightly longer than the first straight section in a second direction perpendicular to the first direction, then bends to extend a distance that makes up the majority of the total length in a third direction that is perpendicular to the first and second directions. In other configurations, the sheath 26 can extend along a serpentine path, a straight path, a curved path, or any designed path. In the example provided, the sheath 26 maintains the generally rectangular cross-section shape from the proximal end 58 to the distal end 62, though other configurations can be used. The sheath 26 is a generally rectangular hollow tube within which the resistance heating element 30 is disposed. The distal end 62, is sealed to prevent moisture from entering the sheath 26 via the distal end 62. In the example provided, the distal end 62 of the sheath 26 is stamped or pressed flat and then welded (e.g., seam welded) to prevent moisture from entering the sheath 26, though other configurations can be used.

The resistance heating element 30 can be encased in a thermally conductive and electrically insulating material 66, such as magnesium oxide for example, to electrically insulate the resistance heating element 30 within the sheath 26 while allowing heat transfer from the resistance heating element 30 to the sheath 26. The resistance heating element 30 is electrically conductive and configured to convert electrical energy (e.g., electrical current) into thermal energy. The resistance heating element 30 can be any suitable configuration for an electrical resistance heating element, such as a resistive heating coil that generates heat from the resistance to electrical current flow (e.g., wound nichrome resistance wires). The resistance heating element 30 is coupled to the first lead 34 and the second lead 38 so that electric current can flow between the first and second leads 34, 38 via the resistance heating element 30. The first and second leads 34, 38 are spaced apart from each other and extend from the proximal end 58 of the sheath 26. The first and second leads 34, 38 are formed of an electrically conductive material and extend into the connector assembly 22 and are electrically coupled to the power cable 18 as discussed in greater detail below. In the example provided, the resistance heating element 30, the first lead 34, and the second lead 38 are configured to operate at high voltage power (e.g., greater than 480 Volts).

The power cable 18 is generally configured to provide electrical power to the resistance heating element 30. The power cable 18 includes a first wire 70, a second wire 74, a third wire 78, an insulating jacket 82, and a plug 86. While not specifically shown, the power cable 18 can also include additional wires, and/or electromagnetic shielding. In the example provided, the first wire 70 is conventionally known as the positive wire, the second wire 74 is conventionally known as the neutral or common wire, and the third wire 78 is conventionally known as the ground wire.

For the majority of their lengths, the first, second, and third wires 70, 74, 78 extend within the insulating jacket 82. The first, second, and third wires 70, 74, 78 each have a corresponding central conductor coated in an electrically insulating coating to inhibit electrical communication between the first, second, and third wires 70, 74, 78 within the power cable 18. In the example provided, a tip of each of the first, second, and third wires 70, 74, 78 extends from an end of the insulating jacket 82 that is opposite the plug 86. Each of the first, second, and third wires 70, 74, 78 is coupled to a corresponding prong 72 of the plug 86 for electrical communication therewith. The plug 86 is configured to physically and electrically be coupled to an electrical power source (not shown) or another cable (not shown) that is connected to the electrical power source to receive electrical power therefrom. In the example provided, the plug 86 includes the prongs 72 and a plug base 88. The plug base 88 has a generally cylindrical portion and a strain relief portion described in greater detail below.

In the example provided, the first, second, and third wires 70, 74, 78 are of a gage of wire configured to provide high voltage electrical power (e.g., greater than 480 Volts) to the resistance heating element 30. The insulating jacket 82 surrounds the first, second, and third wires 70, 74, 78 and is formed of a flexible, electrically insulating and abrasion resistant material. The insulating jacket 82 can also be thermally insulating to withstand high temperatures (e.g., 200° C.) and can be resistant to chemicals and contaminants that may be present in the environment in which the heater 10 is used (e.g., oils, fuels, water, salt, etc.).

The connector assembly 22 is generally configured to couple the heating member 14 to the power cable 18 to provide electrical power to the heating member 14. The connector assembly 22 includes a first fitting 110, a second fitting 114, a grommet 118, a sleeve 122, a grounding pin 126, a first wire connector 130, a second wire connector 134, and a third wire connector 138. In the example provided, the connector assembly 22 also includes a clamp 142, a set of first insulating sleeves 146 (i.e., inner sleeves), a set of second insulating sleeves 150 (i.e., outer sleeves), and a third insulating sleeve 152 (i.e., a perimeter sleeve).

With specific reference to FIGS. 10-14, the first fitting is formed of an electrically conductive material (e.g., stainless steel) and includes a head portion 154 and a first connecting portion 158. The first fitting 110 also defines a first central bore 162. In the example provided, the head portion 154 is a generally cylindrical body disposed about a central axis 166 that includes a pair of flat tool engagement surfaces 170 on diametrically opposite sides of the head portion 154. In an alternative configuration, not shown, the head portion 154 is a polygonal shape configured to be gripped by a tool (not shown). In the example provided, one end of the head portion 154 has a flat end face 174 that forms one axial end 178 of the first fitting 110 and the other end 182 of the head portion 154 is fixedly coupled to the first connecting portion 158. In the example provided, the head portion 154 and the first connecting portion 158 are formed from a single piece of material. In the example provided, the head portion 154 has a maximum outer diameter that is greater than the maximum outer diameter of the first connecting portion 158.

Figure 4:
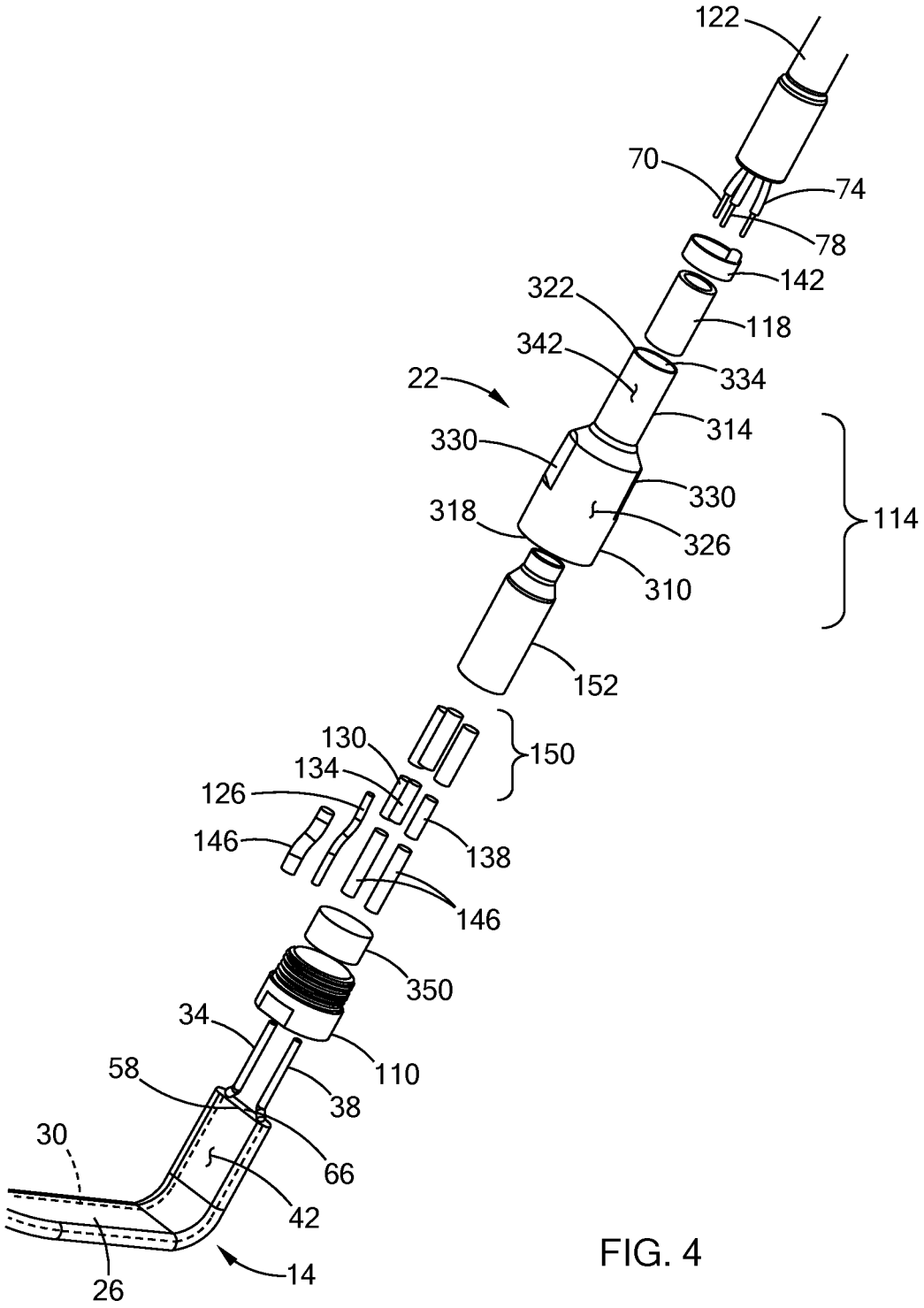
FIG. 4 is an exploded perspective view of the electric heater of FIG. 1.

The head portion 154 includes a slot 186, and a first recess 190 and a second recess 194. In the example provided, the head portion 154 also includes a grounding hole 198. The slot 186 is an elongated slot centered on the central axis 166 and having a shape and size that correspond to the proximal end 58 (FIG. 4) of the sheath 26 (FIG. 4). The slot 186 is open through the end face 174. In the example provided, front and back sides of the slot 186 are defined by flat, opposite side walls 202, 206 that are parallel to each other and longitudinal ends of the slot 186 are defined by end walls 210, 214 that extend between the side walls 202, 206. The side walls 202, 206 of the slot 186 are disposed on opposite sides of the central axis 166.

In the example provided, the end walls 210, 214 of the slot 186 are rounded similar to the side sheath surfaces 50, 54, such that the diameter of the end walls 210, 214 is equal to the distance between the side walls 202, 206 and such that the side walls 202, 206 of the slot 186 are tangent to the end walls 210, 214 of the slot 186. The side walls 202, 206 of the slot 186 are spaced apart a distance that is equal to, or approximately equal to, the distance between the front sheath surface 42 and the back sheath surface 46 so that the proximal end 58 of the sheath 26 can be inserted into the slot 186 (e.g., slip fit, press fit, or interference fit).

The slot 186 extends axially from the end face 174 into the head portion 154 a distance that is less than the full axial length of the head portion 154. The slot 186 terminates in the axial direction at a first shoulder 218 disposed axially within the head portion 154 at the end walls 210, 214 of the slot 186. In the example provided, a maximum radial distance between the end walls 210, 214 of the slot 186 and the central axis 166 can be similar to a maximum radial distance between the central axis 166 and an outermost part of the first connecting portion 158.

The first recess 190 is formed in the first shoulder 218 at one longitudinal end of the slot 186. The first recess 190 extends axially from the first shoulder 218 into the head portion 154 (i.e., away from the end face 174). In the example provided, the first recess 190 terminates axially between the first shoulder 218 and the first connecting portion 158 at a second shoulder 222. In the example provided, the first recess 190 has a curved shape similar to the shape of the end walls 210, 214, but the first recess 190 has a diameter that is less than that of the end walls 210, 214.

The second second recess 194 is formed in the first shoulder 218 at the other longitudinal end of the slot 186. The second recess 194 extends axially from the first shoulder 218 into the head portion 154 (i.e., away from the end face 174). In the example provided, the second recess 194 terminates axially between the first shoulder 218 and the first connecting portion 158 at the second shoulder 222. In the example provided, the second recess 194 has a curved shape similar to the shape of the end walls 210, 214, but the second recess 194 has a diameter that is less than that of the end walls 210, 214. Thus, the first and second recesses 190, 194 can be considered to form a second slot with longitudinal ends that are radially inward of the slot 186 and extends axially from the slot 186 toward the first connecting portion 158.

The first connecting portion 158 is a generally cylindrical body that extends axially from the end 182 of the head portion 154 to an axial end 226 of the first fitting 110. The first connecting portion 158 includes a plurality of external threads 230 disposed about the central axis 166. In the example provided, the external threads 230 have a maximum major diameter that is less than the diameter of the head portion 154. The external threads 230 at the maximum major diameter forms the radially outermost part of the first connecting portion 158. In the example provided, the minor diameter of the external threads 230 is similar to or radially inward of the first and second recesses 190, 194. In the example provided, the external threads 230 are National Pipe Thread Taper (NPT) threads, though other configurations can be used.

The first central bore 162 is disposed about the central axis 166 and open through the axial end 226 of the first fitting. The first central bore 162 extends axially from the axial end 226 toward the other axial end 178 and is defined by an inner surface 234 of the first connecting portion 158 and the head portion 154. The inner surface 234 is radially inward of the first and second recesses 190, 194 and is open to the first and second recesses 190, 194 and the slot 186.

Figure 9:
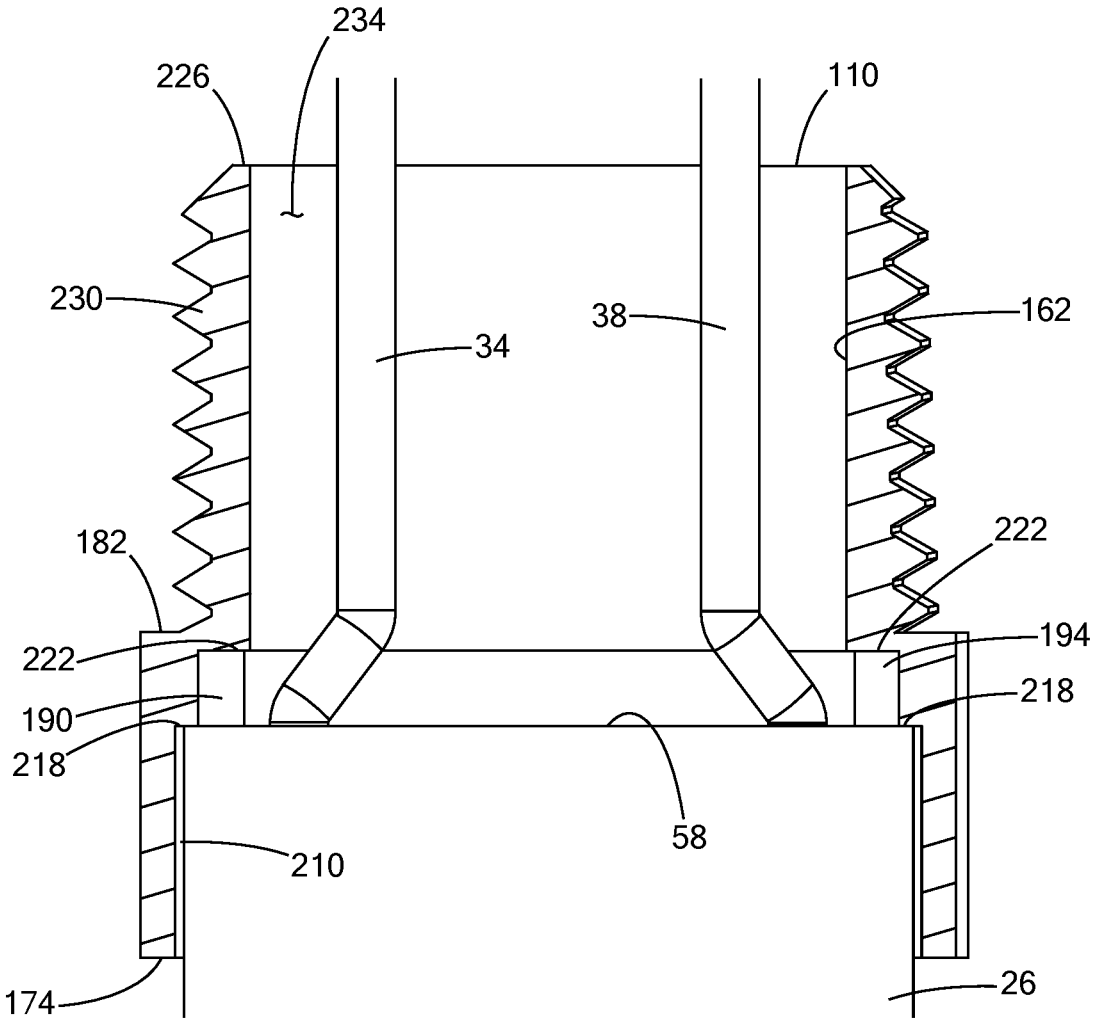
FIG. 9 is a front sectional view of a portion of the connector assembly of FIG. 1.
Figure 10:
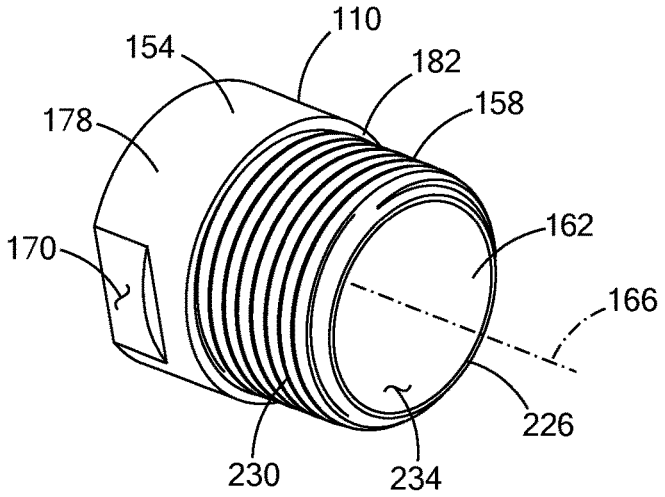
FIG. 10 is a top perspective view of a first fitting of the connector assembly of FIG. 1.
Figure 11:
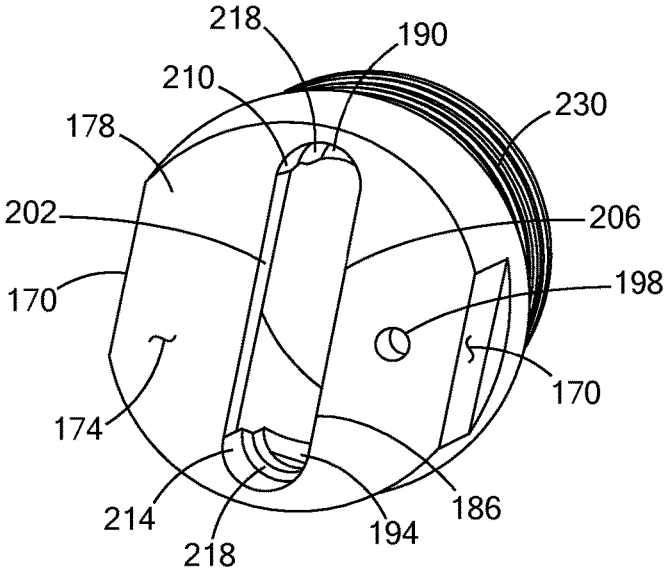
FIG. 11 is a bottom perspective view of the first fitting of FIG. 10.
Figure 12:
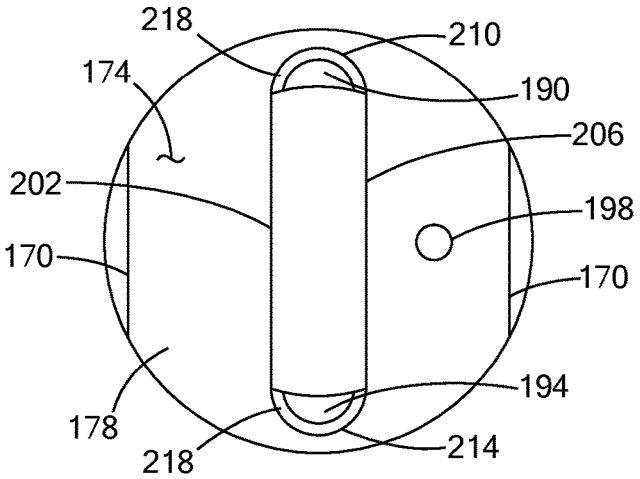
FIG. 12 is a bottom plan view of the first fitting of FIG. 10.
Figure 13:
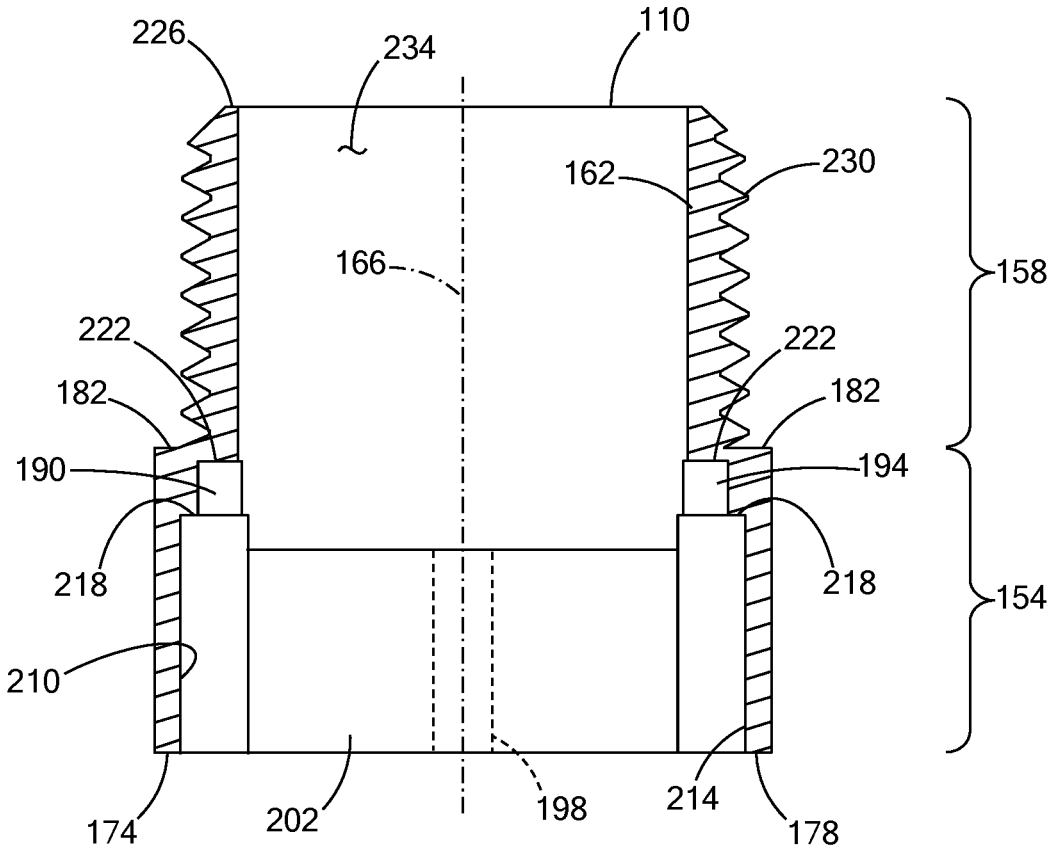
FIG. 13 is a front sectional view of the first fitting of FIG. 10.
Figure 14:
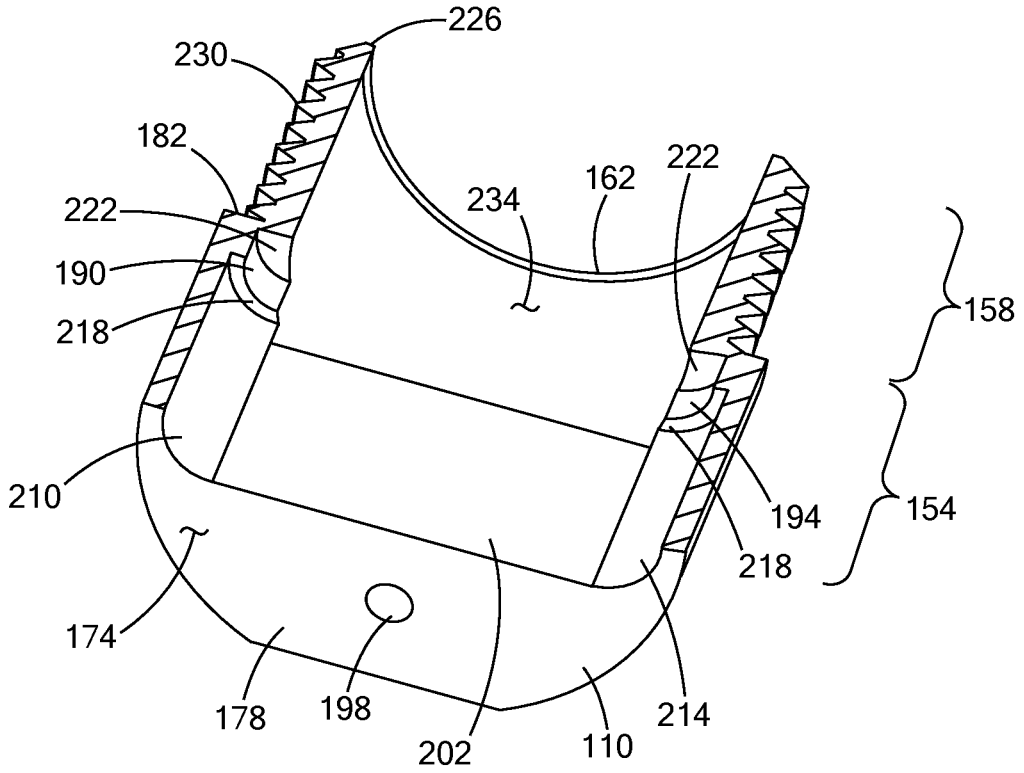
FIG. 14 is a rear perspective sectional view of the first fitting of FIG. 10.

As best shown in FIG. 9, the proximal end of the sheath 26 can be inserted into the slot 186 until the proximal end 58 contacts the first shoulder 218. Once in this position, the proximal end 58 is then welded (e.g., seam welded) to the head portion 154. In the example provided, the first lead 34 emerges from the proximal end 58 within, or near the first recess 190. The first lead 34 can emerge from the proximal end 58 partially within the first recess 190 and partially within the first central bore 162, or can emerge within the first central bore 162 near the first recess 190. The first lead 34 then extends at an angle axially away from the proximal end 58 and radially toward the central axis 166 until the first lead 34 is a predetermined distance from the inner surface of the first fitting 110. Then the first lead 34 extends primarily in the direction away from the proximal end 58 and generally parallel to the central axis 166. In the example provided, the first lead 34 extends axially through the first central bore 162 to exit the first fitting 110 through the axial end 226.

In the example provided, the second lead 38 is similar to the first lead 34, but emerges from the proximal end 58 within, or near the second recess 194. The second lead 38 can emerge from the proximal end 58 partially within the second recess 194 and partially within the first central bore 162, or can emerge within the first central bore 162 near the second recess 194. The second lead 38 then extends at an angle axially away from the proximal end 58 and radially toward the central axis 166 until the second lead 38 is a predetermined distance from the inner surface of the first fitting 110. Then the second lead 38 extends primarily in the direction away from the proximal end 58 and generally parallel to the central axis 166. In the example provided, the second lead 38 extends axially through the first central bore 162 to exit the first fitting 110 through the axial end 226.

Thus, the first and second recesses 190, 194 allow the first and second leads 34, 38 to enter the sheath 26 further radially outward from the central axis 166 while providing clearance space between the first and second leads 34, 38 and the interior of the first fitting 110. This clearance space provided by the first and second recesses 190, 194 can prevent contact between first and second leads 34, 38 and the first fitting 110 and provide room for the insulation of the first insulating sleeves 146 about the first and second leads 34, 38. This configuration with the slot 186 and the first and second recesses 190, 194 permits the electric heater 10 to use a generally rectangular heating sheath 26, with a generally rectangular proximal end 58 interfacing the first fitting 110. This configuration permits the overall assembly length and of the connector assembly 22 and heating member 14 to be minimized, while allowing for the diameter of the connector assembly to be minimized.

Figure 8:
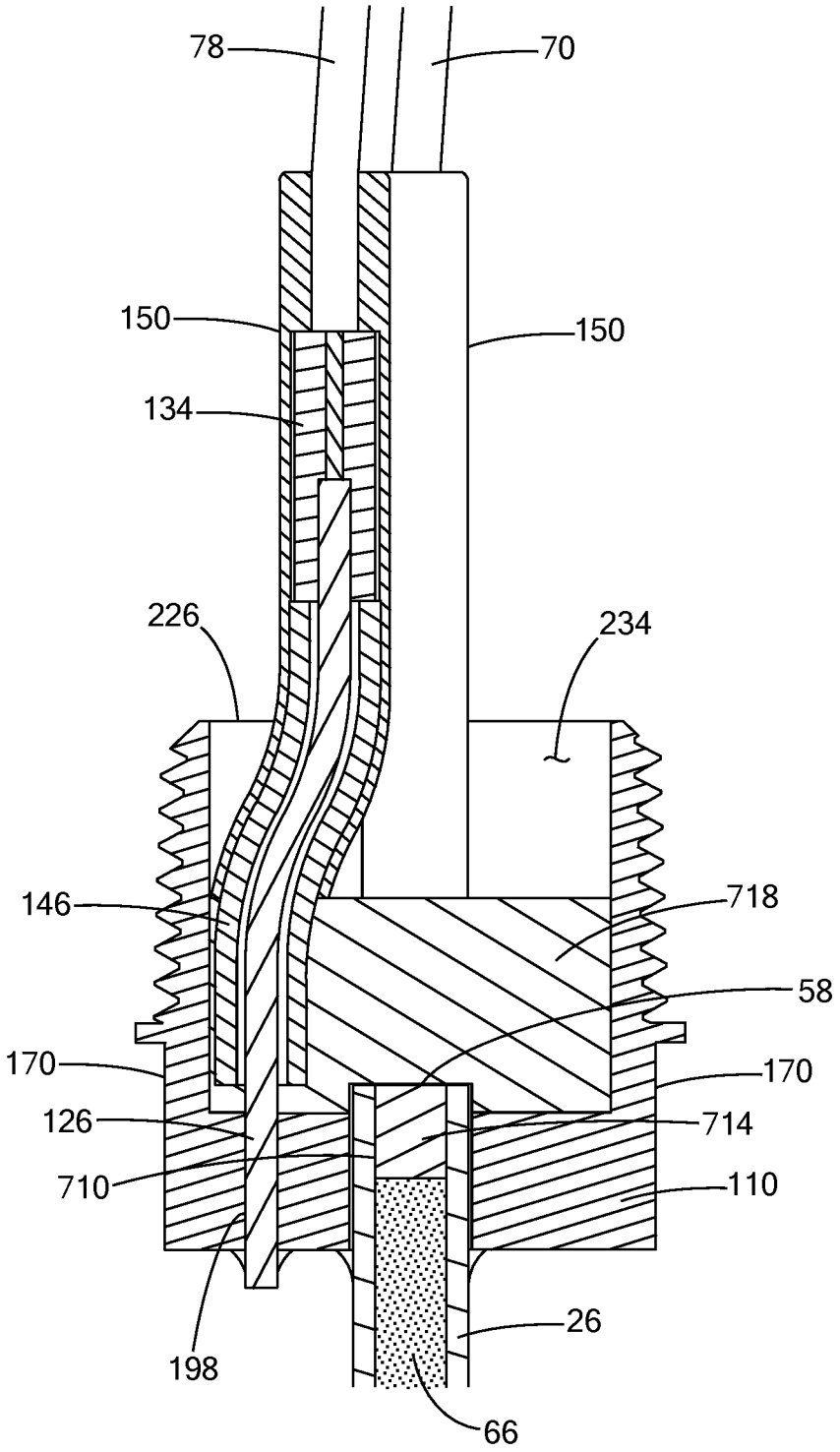
FIG. 8 is a side sectional view of a portion of the connector assembly of FIG. 1.

As best shown in FIG. 8, the grounding hole 198 is open through the end face 174 to be open into the first central bore 162, spaced apart from the slot 186. The grounding pin 126 is a generally cylindrical conductor and is inserted into the grounding hole 198 and connected therein to provide electrical communication with the first fitting 110. In the example provided, the grounding pin 126 is welded to the first fitting 110 while extending through the grounding hole 198. Since the first fitting 110, grounding pin 126, and sheath 26 are electrically conductive materials and coupled together (e.g., via contact and welding), the sheath 26 is in electrical communication with the grounding pin 126.

The first insulating sleeves 146 are formed of a high-temperature, electrically insulating material. In the example provided, the first insulating sleeves 146 are formed of fiberglass and silicone, though other constructions can be used. In an alternative construction, not specifically shown, the first insulating sleeves 146 can be formed of a heat shrinking material that conforms to and tightens around the material about which it is applied when heated above a predetermined temperature.

Figure 7:
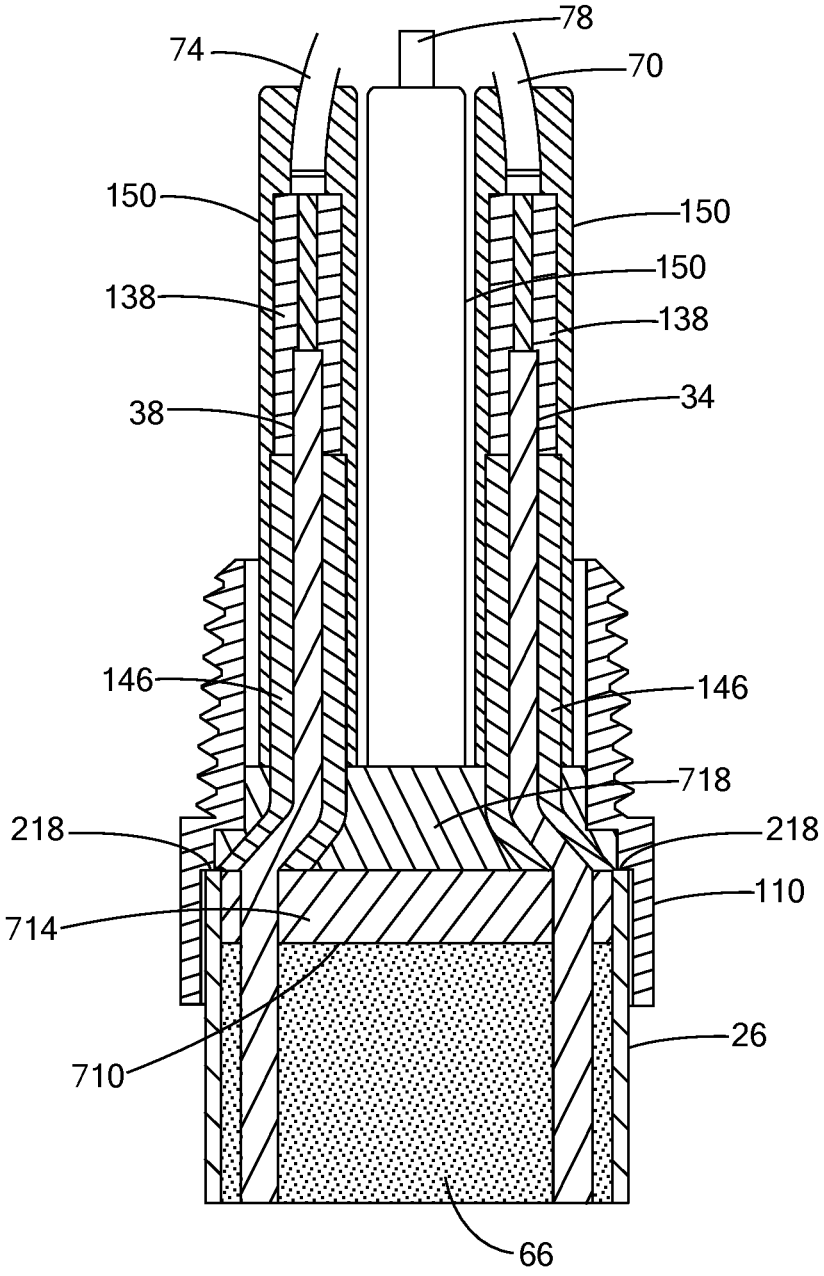
FIG. 7 is a rear sectional view of a portion of the connector assembly of FIG. 1.

As best shown in FIG. 7, one of the first insulating sleeves 146 is disposed about the first lead 34. Another one of the first insulating sleeves 146 is disposed about the second lead 38. A third one of the first insulating sleeves 146 is disposed about the grounding pin 126. The first insulating sleeves 146 electrically insulate the first lead 34, second lead 38, and grounding pin 126 from each other and from the first fitting 110. In the example provided, the first insulating sleeves 146 cover the first and second leads 34, 38 from the proximal end 58 of the sheath 26 and extend axially through the axial end 226 of the first fitting 110. A tip of each of the first and second leads 34, 38 extends axially from the corresponding first insulating sleeve 146 at a location outside of the first fitting 110. The corresponding first insulating sleeve 146 covers the grounding pin 126 from the location where it enters the grounding hole 198 and extends axially through the axial end 178 of the first fitting 110. A tip of the grounding pin 126 extends axially from the corresponding first insulating sleeve 146 at a location outside of the first fitting 110.

In the example provided, with the sheath 26 attached to the first fitting 110, the first and second leads 34, 38 and the grounding pin 126 extending through the first fitting 110 and surrounded by the first insulating sleeves 146, the first central bore 162 is then filled with potting 350 (FIG. 4). The potting 350 (FIG. 4) can be a high-temperature, thermally insulating epoxy with operating temperatures of approximately 230° C., which can have excellent insulating properties at such operating temperatures and can have higher resistance to cracking from thermal cycling than other potting materials with similarly hard durometers (e.g., 80-90 Shore D range durometers). In the example provided, the potting 350 (FIG. 4) can be poured into the first fitting 110 as a liquid and cured to become a solid within the first fitting 110. In the example provided, the first central bore 162 is filled to a level that is axially approximately half way between the opposite ends of the first connecting portion 158, though other configurations can be used. In one alternative example, the potting 350 (FIG. 4) can fill the entire first central bore 162 to reach the axial end 226.

Figure 5:
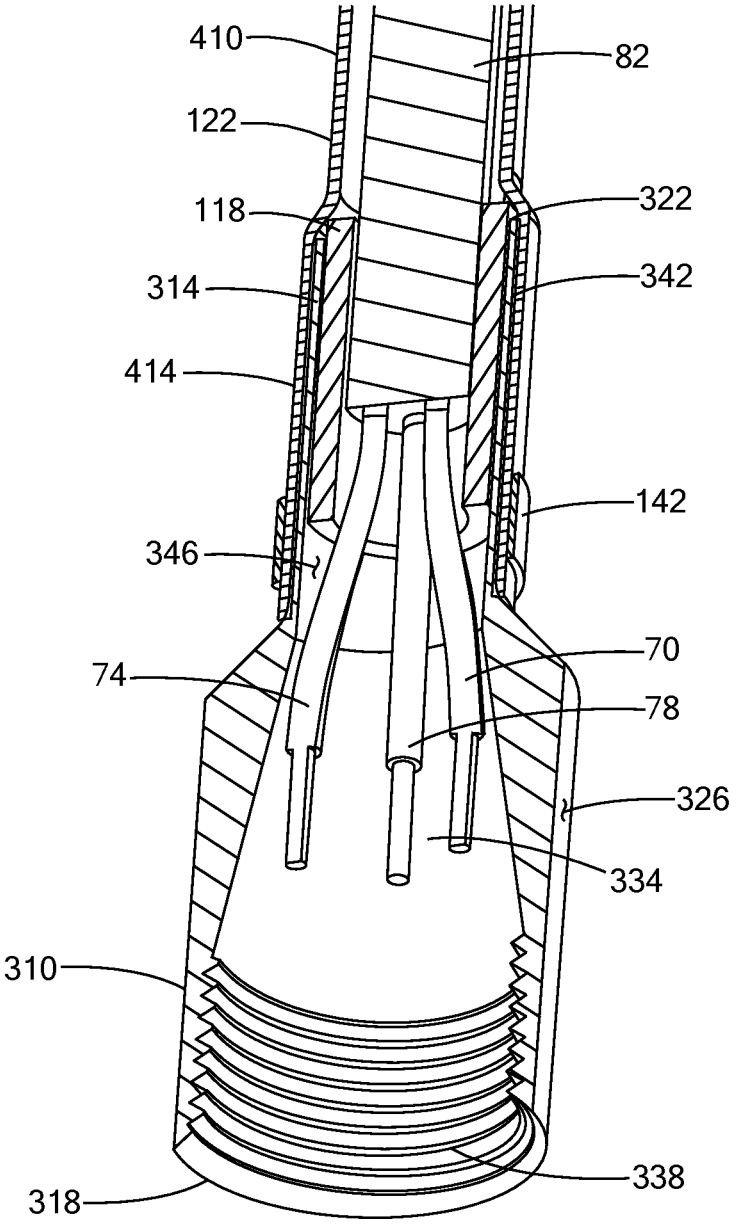
FIG. 5 is a perspective sectional view of a portion of the connector assembly of FIG. 1.
Figure 6:
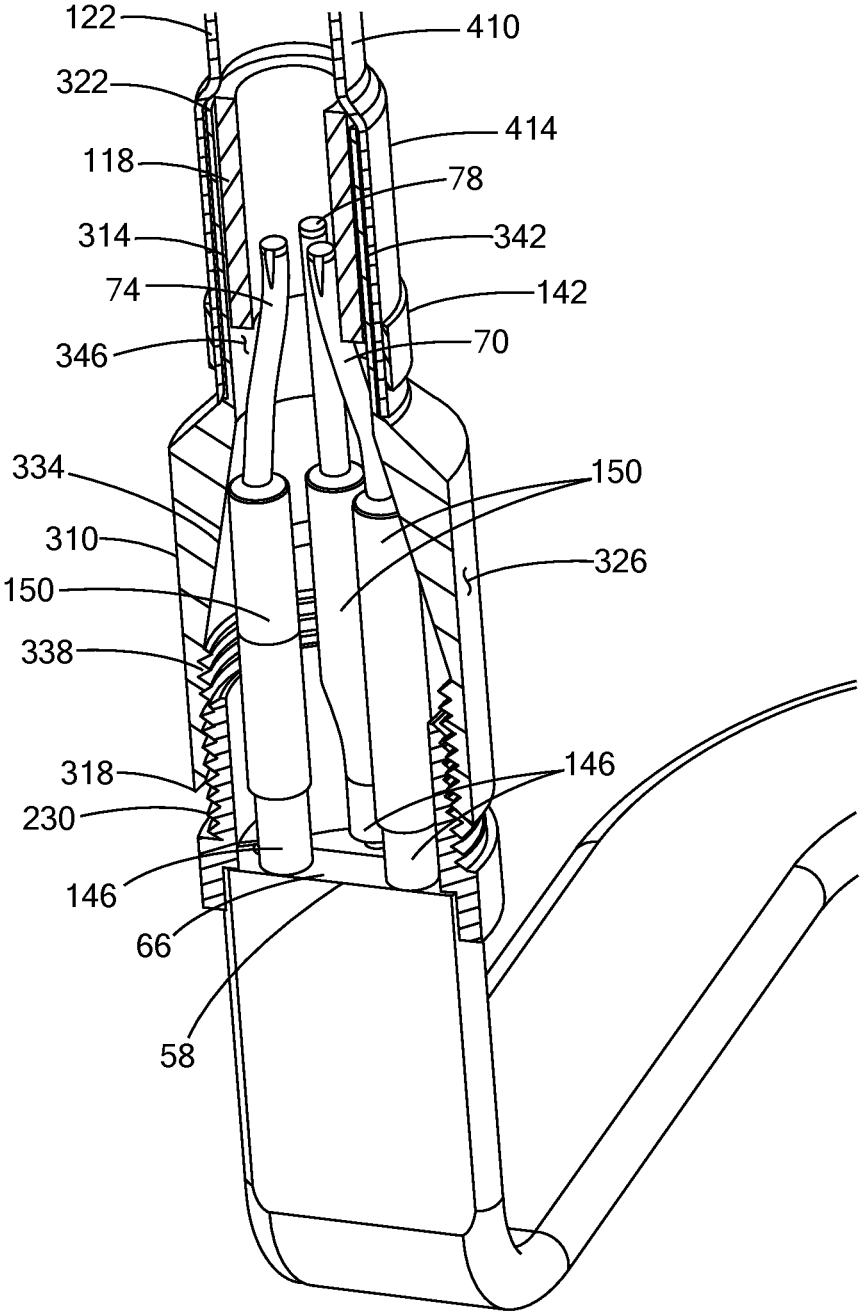
FIG. 6 is a perspective partial sectional view of the connector assembly of FIG. 1.

With specific reference to FIGS. 4-6, the second fitting 114 is a generally cylindrically shaped body disposed about the central axis 166. The second fitting 114 includes a second connecting portion 310 and a tubular portion 314. The second connecting portion 310 extends from an axial end 318 of the second fitting 114 to the tubular portion 314. The tubular portion 314 extends axially from the second connecting portion 310 to a second axial end 322 of the second fitting 114.

In the example provided, the second connecting portion 310 has an outer surface 326 that is generally cylindrical about the central axis 166 and has a diameter similar to the diameter of the head portion 154 of the first fitting 110. In the example provided, the second connecting portion 310 includes a pair of flat surfaces 330 recessed from outer surface 326 on opposite sides of the central axis 166. The flat surfaces 330 are configured to permit a tool (not shown) to grip and impart a torque on the second connecting portion 310 about the central axis 166. In the example provided, an end of the second connecting portion 310 that is distal to the axial end 318 tapers radially inward to a diameter of the tubular portion 314, which is less than the diameter of the outer surface 326.

The second fitting 114 includes a second central bore 334 that is disposed about the central axis 166 and extends axially through the second fitting 114 and is open at both axial ends 318, 322 of the second fitting 114. The second connecting portion 310 includes a plurality of internal threads 338 disposed about the central axis 166 proximate to the axial end 318. The internal threads 338 are configured to threadably engage the external threads 230 of the first fitting 110. In the example provided, the internal threads 338 are NPT threads. The internal threads 338 extend axially from the axial end 318 and terminate within the central bore at a location between the axial end 318 and the tubular portion 314. In the example provided, the second central bore 334 narrows from a diameter similar to the minor diameter of the internal threads where the internal threads 338 terminate, to a lesser diameter proximate to the tubular portion 314.

The tubular portion 314 is a generally cylindrical body fixedly coupled to the second connecting portion 310. In the example provided, the tubular portion 314 and the second connecting portion 310 are formed from a single piece of material. The second fitting 114 can be formed of a material similar to the first fitting 110, such as (stainless steel). The tubular portion 314 has an outer surface 342 that is generally cylindrical with a diameter that is less than the diameter of the outer surface 326 of the second connecting portion 310. The tubular portion 314 has an inner cylindrical surface 346 that defines the portion of the second central bore 334 that extends through the tubular portion 314.

The grommet 118 is a tubular seal member that is disposed in the second central bore 334 proximate to the axial end 322. The grommet 118 is a resilient material (e.g., rubber or flouroelastomeric material) that has an uncompressed outer diameter that is greater than the diameter of the second central bore 334 at the tubular portion 314. The inner diameter of the grommet 118 is configured to receive a length of the insulating jacket 82 of the power cable 18. The grommet 118 is configured to be disposed in the tubular portion 314 with the insulating jacket 82 surrounded by the grommet 118 and the first, second, and third wires 70, 74, 78 extending through the grommet 118 and into the second central bore 334.

In the example provided, the first, second, and third wire connectors 130, 134, 138 are barrel crimp electrical connectors. The first lead 34 is inserted into one end of the first wire connector 130 and the exposed conductor of the first wire 70 is inserted into the opposite end of the first wire connector 130. Then the first wire connector 130 is crimped (i.e., deformed radially inward) until the first lead 34 and the conductor of the first wire 70 are securely gripped by the first wire connector 130. The first wire connector 130 couples the first lead 34 to the conductor of the first wire 70 for electrical communication therewith.

Similarly, the second lead 38 is inserted into one end of the second wire connector 134 and the exposed conductor of the second wire 74 is inserted into the opposite end of the second wire connector 134. Then the second wire connector 134 is crimped (i.e., deformed radially inward) until the second lead 38 and the conductor of the second wire 74 are securely gripped by the second wire connector 134. The second wire connector 134 couples the second lead 38 to the conductor of the second wire 74 for electrical communication therewith.

Similarly, the grounding pin 126 is inserted into one end of the third wire connector 138 and the exposed conductor of the third wire 78 is inserted into the opposite end of the third wire connector 138. Then the third wire connector 138 is crimped (i.e., deformed radially inward) until the grounding pin 126 and the conductor of the third wire 78 are securely gripped by the third wire connector 138. The third wire connector 138 couples the grounding pin 126 to the conductor of the third wire 78 for electrical communication therewith.

The second insulating sleeves 150 are formed of a high-temperature, electrically insulating material. In the example provided, the second insulating sleeves 150 are formed of fiberglass and silicone, though other constructions can be used. In an alternative construction, not specifically shown, the second insulating sleeves 150 are formed of a heat shrinking material that conforms to and tightens around the material about which it is applied when heated above a predetermined temperature.

As best shown in FIG. 7, one of the second insulating sleeves 150 is disposed about the first wire connector 130. Another one of the second insulating sleeves 150 is disposed about the second wire connector 134. A third one of the second insulating sleeves 150 is disposed about the third wire connector 138. In the example provided, the second insulating sleeves 150 also surround and overlap with a portion of the first insulating sleeves 146 that extend axially out from the first fitting 110. In the example provided, the second insulating sleeves 150 also surround and overlap a portion of the insulating coating of the first, second, and third wires 70, 74, 78 that extends from the first, second, and third wire connectors 130, 134, 138. The second insulating sleeves 150 electrically insulate the first wire connector 130, the second wire connector 134, and the third wire connector 138 from each other and from the second fitting 114. The third insulating sleeve 152 is a rubber coated fiberglass material and surrounds and overlaps the first wire connector 130, the second wire connector 134, the third wire connector 138. In the example provided, the third insulating sleeve 152 also surrounds the second insulating sleeves 150, and the portions of the first lead 34, the second lead 38, the first insulating sleaves 146 and the ground pin 126 that extend from the potting 350. In an alternative configuration, not specifically shown, the grommet 118 extends axially into the second central bore 334 to overlap and surround a portion of the second insulating sleeves 150.

Returning to the example provided, with the first, second, and third wires 70, 74, 78 connected to the first lead 34, the second lead 38, and the grounding pin 126, and insulated, the second fitting 114 is then threaded onto the first fitting 110. A thread sealant (e.g., a polytetrafluoroethylene "PTFE" or other thread sealant suitable for inhibiting moisture, liquids, and other contaminants from getting between the threads) can be applied between the internal threads 338 and the external threads 230. The thread sealant can also be a thread locking material. The second fitting 114 can be threaded onto the first fitting 110 to a predetermined torque value to secure the first fitting 110 to the second fitting 114.

Once the first and second fittings 110, 114 are secured together, the tubular portion 314 is crimped (i.e., deformed radially inward) to compress the grommet 118 between the tubular portion 314 and the insulating jacket 82. The tubular portion 314 is crimped substantially uniformly about its circumference so that the crimped tubular portion 314 has a crimped outer diameter that is less than the outer diameter of the uncrimped tubular portion 314. The crimped diameter is such that the inner surface of the crimped tubular portion 314 secures the grommet 118 and power cable 18 within the tubular portion 314 and the grommet 118 forms a seal between the tubular portion 314 and the power cable 18. The resilience of the grommet 118 can also provide strain relief to inhibit kinking of the power cable 18 at the tubular portion 314 while maintaining the seal with a bent power cable 18.

In the example provided, the sleeve 122 is a one-piece sleeve that is flexibly expandable to form into a main portion 410 and a cuff portion 414 during assembly. The main portion 410 surrounds a length of the insulating jacket 82 that extends from the second fitting 114. In the example provided, the main portion 410 extends the full length of the power cable 18 to the plug 86. In the example provided, the strain relief portion of the plug 86 is overmolded over the insulating jacket 82 and the sleeve 122 to form a seal with the sleeve 122. The strain relief portion can optionally have of grooves arranged to permit flexibility while inhibiting kinking of the cable 18 at the junction of the cable 18 and the plug 86. In an alternative construction, not specifically shown, the main portion 410 can end along the power cable 18 at a location before the plug 86.

Returning to the example provided, the cuff portion 414 can stretch to have a slightly larger diameter than the main portion 410 and surrounds the tubular portion 314 of the second fitting 114. The sleeve 122 can be formed of a resilient material such that the main portion 410 can have a relaxed diameter that is less than the outer diameter of the insulating jacket 82 and the cuff portion 414 can have a relaxed diameter that is less than the outer diameter of the crimped tubular portion 314. In this way, the main portion 410 can sealingly engage the insulating jacket 82 and the cuff portion 414 can sealingly engage the tubular portion 314. In the example provided, the sleeve 122 is formed of a fiberglass reinforced rubber material that is resistant to water, oil, fuels, corrosive chemicals and other contaminants, as well as abrasion and high temperatures (e.g., 200° C.), though other materials can be used. The sleeve 122 can also provide bending support to the power cable 18 to inhibit kinking at the intersection with the tubular portion 314 of the second fitting 114.

The clamp 142 surrounds a length of the cuff portion 414 and the tubular portion 314 and is tightened therearound to secure the sleeve 122 to the tubular portion 314. The clamp 142 can secure the sleeve 122 to the tubular portion 314 such that the cuff portion 414 forms a seal against the tubular portion 314 to inhibit fluids, moisture and other contaminants from passing therebetween. In the example provided, the clamp 142 is a stainless steel, one-ear clamp, though other configurations can be used.

Referring to FIGS. 1-14, one non-limiting example of a method of connecting the power cable 18 to the heater member 14 is described. The grounding pin 126 is inserted into the grounding hole 198 and welded to the first fitting 110. The proximal end 58 of the sheath 26 is inserted into the slot 190 of the first fitting 110 so that the first and second leads 34, 38 extend into the first fitting 110. The sheath 26 is then welded to the first fitting 110, such as by a fillet weld around the entire perimeter of the sheath 26 to seal the slot 190. The sheath 26 is then be bent into the desired shape for the particular application. The sheath 26 is then baked in an oven at high temperatures to remove moisture from within the sheath 26.

In the example provided, some of the magnesium oxide that fills the sheath 26 can be removed from the proximal end 58 that is within the first fitting 110. In the example provided, the removal of magnesium oxide creates a cavity 710 (shown in FIG. 7) that extends into the sheath 26 by approximately 0.25 inches, though other configurations can be used. High-temperature potting material 714 (shown in FIG. 7) is then poured into the cavity 710 to fill the cavity 710 and form a first layer of potting material. The high-temperature potting material 714 is then cured to solidify as this first layer.

The first insulating sleeves 146 are then positioned on the first lead 34, the second lead 38, and the grounding pin 126 so that the first insulating sleeves 146. Next, a second layer of high-temperature potting material 718 (shown in FIG. 7) is poured into the first fitting 110 to surround at least a portion of the first insulating sleeves 146. The second layer of potting material 718 is then cured to solidify as this second layer. Then, high temperature thread sealant (not specifically shown, e.g., Polytetrafluoroethylene tape) is applied to the threads of the first fitting 110.

Next, the clamp 142 and the grommet 118 can be slid onto and positioned on the cable 18 around the insulating jacket 82 or sleeve 122. The cable 18 is then slid into the second axial end 322 of the second fitting 114 and the second insulating sleeves 150 are slid onto the first, second, and third wires 70, 74, 78 and the third insulating sleeve 152 is slid around the wires 70, 74, 78. The first, second, and third wires 70, 74, 78 are then connected to their corresponding first, second lead 34, 38 or the ground pin 126. The second insulating sleeves 150 are then slid down over the connectors 130, 134, 138 to cover the connectors 130, 134, 138 and at least a portion of the insulated area of the wires 70, 74, 78, and at least a portion of the first insulating sleeves 146. The third insulating sleeve 152 is then positioned to surround the first insulating sleeves 146.

Next, the second fitting 114 is threaded onto the first fitting 110. Then, the grommet 118 is slid into the tubular portion 314 and the tubular portion 314 is crimped to compress the grommet 118 between the tubular portion 314 and the insulating jacket 82. Then, the sleeve 122 is slid over the crimped tubular portion 314 and the clamp is tightened around the sleeve 122 to secure it to the tubular portion 314.

The method steps, processes, and operations described herein are not to be construed as necessarily requiring their performance in the particular order discussed or illustrated, unless specifically identified as the only possible order of performance. It is also to be understood that additional or alternative steps may be employed.

Thus, the teachings of the present disclosure provide a robust high voltage electric heater 10 that has an overall compact assembly length and diameter, while having high resistance to fluids, moisture, contaminants, abrasion, high temperature fluctuations.

The description of the disclosure is merely exemplary in nature and, thus, variations that do not depart from the substance of the disclosure are intended to be within the scope of the disclosure. Such variations are not to be regarded as a departure from the spirit and scope of the disclosure.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "including," and "having," are inclusive and therefore specify the presence of stated features, integers, steps, operations, elements, and/or components, but do not preclude the presence or addition of one or more other features, integers, steps, operations, elements, components, and/or groups thereof.

When an element or layer is referred to as being "on," "engaged to," or "coupled to," another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections, should not be limited by these terms. These terms may be only used to distinguish one element, component, region, layer and/or section, from another element, component, region, layer and/or section. Terms such as "first," "second," and other numerical terms when used herein do not imply a sequence or order unless clearly indicated by the context. Thus, a first element, component, region, layer or section, could be termed a second element, component, region, layer or section without departing from the teachings of the example embodiments. Furthermore, an element, component, region, layer or section may be termed a "second" element, component, region, layer or section, without the need for an element, component, region, layer or section termed a "first" element, component, region, layer or section.

Specially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above or below. The device may be otherwise oriented (rotated 90 degrees or at other orientations) and the spatially relative descriptors used herein interpreted accordingly.

What is claimed is:

1. An electrical heater comprising:

a heating member including a thermally conductive sheath, a resistance heating element, a first lead, and a second lead, the resistance heating element being disposed within the sheath, the first and second leads being coupled to the resistance heating element and extending from a proximal end of the sheath;

a cable including an insulating jacket, a first wire, and a second wire, the first and second wires being disposed within the insulating jacket and extending from a proximal end of the insulating jacket; and a connector coupling the heating member to the cable, the connector including:

a first fitting including a first connecting portion and a head portion, the first connecting portion defining threads disposed about an axis, the head portion being axially adjacent to the first connecting portion, the head portion defining a slot open through an end of the head portion that is opposite the first connecting portion, the first fitting including a first central bore disposed about the axis, the first central bore being open to the slot and open through an end of the first connecting portion that is opposite the head portion, the proximal end of the sheath being received in the slot and welded to the first fitting, the first lead extending from the sheath into the first central bore, the second lead extending from the sheath into the first central bore; and a second fitting including a second connecting portion that defines threads threadably engaged with the threads of the first fitting, the second fitting defining a second central bore disposed about the axis, wherein an end of the cable extends into the second central bore, the first wire is coupled to the first lead for electrical communication therewith, and the second wire is coupled to the second lead for electrical communication therewith.

2. The electrical heater of claim 1, wherein a first layer of potting material is disposed within the proximal end of the sheath, the first layer of potting material sealing the proximal end of the sheath, a portion of the first and second leads extend from the first layer of potting material, wherein the connector includes a plurality of inner sleeves, one of the inner sleeves is disposed about the portion of the first lead that extends from the first layer of potting material, another one of the inner sleeves is disposed about the portion of the second lead that extends from the first layer of potting material, wherein a second layer of potting material is disposed within the first fitting about a portion of the inner sleeves that is adjacent to the first layer of potting material.

3. The electrical heater of claim 2, wherein the connector includes a plurality of outer sleeves, one of the outer sleeves being disposed about a connection between the first wire and the first lead, an insulating coating of the first wire, and a portion of the inner sleeve that is disposed about the first lead, another one of the outer sleeves being disposed about a connection between the second wire and the second lead, an insulating coating of the second wire, and a portion of the inner sleeve that is disposed about the second lead.

4. The electrical heater of claim 3, wherein the outer sleeve does not extend into the second layer of potting material.

5. The electrical heater of claim 3, wherein the connector includes a perimeter sleeve that is disposed about the plurality of outer sleeves.

6. The electrical heater of claim 1, wherein the slot is defined by a first side wall, a second side wall parallel to the first side wall, a first end wall joining one end of the first and second side walls, and a second end wall joining an opposite end of the first and second side walls, the side walls being longer than the end walls, the proximal end of the sheath having a shape that is similar to and mates with the slot.

7. The electrical heater of claim 6, wherein the first and second end walls are rounded.

8. The electrical heater of claim 6, wherein the first and second end walls extend radially outward of a minor diameter of the threads of the first fitting.

9. The electrical heater of claim 1, further comprising a grommet, wherein the second fitting includes a tubular portion disposed about the axis and extending from an end of the second connecting portion, the grommet being formed of a resilient material and being a generally cylindrical shape that has a relaxed outer diameter that is greater than an inner diameter of the tubular portion, the first and second wires extending through the grommet.

10. The electrical heater of claim 9, further comprising a cable sleeve, the cable sleeve surrounding a portion of the insulating jacket proximate to the tubular portion and extending over the tubular portion, the cable sleeve forming a seal with the tubular portion.

11. The electrical heater of claim 10, further comprising a clamp disposed about the sleeve and the tubular portion, the clamp secures the sleeve to the tubular portion.

12. The electrical heater of claim 1, wherein the cable further includes a third wire coupled for electrical communication with the sheath.

13. The electrical heater of claim 12, further comprising a ground pin coupled to the first fitting, wherein the third wire is connected to the ground pin.

14. The electrical heater of claim 13, wherein the first fitting defines a grounding bore in the end of the head portion opposite the first connecting portion, the ground pin extending into the grounding bore and welded to the first fitting.

15. The electrical heater of claim 1, wherein the head portion of the first fitting defines a first recess and a second recess, the first recess being recessed from a shoulder of the slot at a first longitudinal end of the slot, the second recess being recessed from a shoulder at a second longitudinal end of the slot, the first lead extending from the sheath proximate to the first recess and angling toward the first central bore, the second lead extending from the sheath proximate to the second recess and angling toward the first central bore.

16. The electrical heater of claim 15, wherein the first lead is surrounded by a first insulating sleeve that extends partially within the first recess and the second lead is surrounded by a second insulating sleeve that extends partially within the second recess.

17. The electrical heater of claim 15, wherein the first and second recesses extend radially outward of a minor diameter of external threads.

18. A method of coupling a power cable to an electric heater member, the power cable including a first wire, a second wire, and an insulating jacket, the heater member including a resistance heating element, a sheath surrounding the resistance heating element, and first and second leads coupled to the resistance heating element and extending from a proximal end of the sheath, the method including:

inserting the proximal end of the sheath into a slot of a first fitting so that the first and second leads extend through the first fitting;

welding the sheath to the first fitting;

inserting a portion of the cable through a tubular portion of a second fitting;

coupling the first lead to the first wire;

coupling the second lead to the second wire;

threading the second fitting onto the first fitting; and crimping the tubular portion about the cable to secure the cable relative to the tubular portion.

19. The method of claim 18, further comprising:

baking the sheath to remove moisture from within the sheath.

20. The method of claim 18, further comprising:

inserting the portion of the cable through a resilient grommet; and inserting the resilient grommet into the tubular portion before crimping the tubular portion, the grommet having a relaxed outer diameter that is greater than a crimped inner diameter of the tubular portion so that the grommet forms a seal between the insulating jacket and the tubular portion after crimping the tubular portion.

21. The method according to claim 18, further comprising:

positioning an outer sleeve over the tubular portion and a length of the insulating jacket after crimping the tubular portion; and securing the outer sleeve to the tubular portion.

22. The method of claim 18, further comprising:

welding a grounding pin to the first fitting; and connecting a third wire of the cable to the grounding pin for electrical communication therewith.

23. The method of claim 18, further comprising applying a high-temperature thread sealant to threads of at least one of the first and second fittings before threading the second fitting onto the first fitting.

24. The method of claim 18, further comprising:

pouring a first layer of potting material into the proximal end of the sheath; and curing the first layer of potting material to seal the proximal end of the sheath.

25. The method of claim 24, further comprising:

positioning a first inner sleeve about the first lead and a second inner sleeve about the second lead;

pouring second layer of potting material into the first fitting around the first and second inner sleeves; and curing the second layer of potting material.

26. The method of claim 25, further comprising:

positioning a first outer sleeve so that the first outer sleeve is disposed about the first wire, a connection between the first wire and the first lead, and a portion of the first inner sleeve; and positioning a second outer sleeve so that the second outer sleeve is disposed about the second wire, a connection between the second wire and the second lead, and a portion of the second inner sleeve.

27. The method according to claim 26, further comprising positioning a perimeter sleeve so that the perimeter sleeve is within the first and second fittings and disposed about the first and second outer sleeves.

* * * * *